US005759023A

United States Patent [19]

Jenlis

[11] Patent Number: 5,759,023

[45] Date of Patent: Jun. 2, 1998

[54] LIGHTER INCLUDING A WHEEL ASSEMBLY THEREFOR

[75] Inventor: Pascal de Jenlis, Saint Cloud, France

[73] Assignee: Hameur et Cie, Paris, France

[21] Appl. No.: 710,137

[22] Filed: Sep. 13, 1996

[30] Foreign Application Priority Data

Mar. 16, 1995 [FR] France ..... 95 03037

[51] Int. Cl.[6] ..... F23D 11/36

[52] U.S. Cl. ..... 431/153; 431/277

[58] Field of Search ..... 431/277, 153, 431/276

[56] References Cited

U.S. PATENT DOCUMENTS

| | | | |
|---|---|---|---|
| 1,726,237 | 8/1929 | Patnaude | 431/277 |
| 1,743,610 | 1/1930 | Lagerholm | 431/277 |
| 2,443,123 | 6/1948 | Solon | 431/273 |
| 4,717,335 | 1/1988 | Loveless | 431/277 |
| 4,822,276 | 4/1989 | Bisbee | 431/273 |
| 5,096,414 | 3/1992 | Zellweger | 431/277 |
| 5,460,516 | 10/1995 | Sher | 431/277 |
| 5,547,370 | 8/1996 | Hwang | 431/277 |

FOREIGN PATENT DOCUMENTS

| | | | |
|---|---|---|---|
| 2568353 | 1/1986 | France | F23Q 1/02 |
| 3609674 | 9/1986 | Germany | 431/273 |
| 677021 | 3/1991 | Switzerland | F23Q 2/46 |
| WO 95/04247 | 2/1995 | WIPO | F23Q 2/00 |

*Primary Examiner*—Carl D. Price

*Attorney, Agent, or Firm*—Greenblum & Bernstein, P.L.C.

[57] ABSTRACT

The invention is related a lighter, particularly a lighter having a child safety feature. In a specific embodiment, the invention includes a wheel assembly that includes a central striking wheel surrounded by two wheel drivers. Arrangements are provided for diminishing the adherence of a finger on the drivers, particularly the finger of a young child, to render the ignition of the lighter difficult for children.

41 Claims, 4 Drawing Sheets

LIGHTER INCLUDING A WHEEL ASSEMBLY THEREFOR

BACKGROUND OF THE INVENTION

1. Field of the Invention

The present invention is related to a safety lighter and, particularly, to a wheel assembly for a safety lighter, adapted to render difficult and practically impossible the lighting of the lighter by a young child.

2. Discussion of Background and Material Information

Various child-proof safety apparatus have previously been proposed for lighters. For the most part, they are intended to prevent the release of fuel and, as a result, lighting of the lighter by means of a more or less complicated mechanism which requires a combination of movements which are not evident to a young child.

In flint lighters, the production of sparks results from friction resulting from the rotation, at a low velocity, of a wheel having an abrasive toothing or knurling, above a flint pressed against the wheel under the action of a spring. A wheel assembly of this type of lighter generally includes three elements, which are:

- a central portion in the form of a striking wheel that includes the abrasive toothing or knurling causing the sparks during friction with the flint; and
- two lateral portions, commonly referred to as driving wheels or drivers.

The driving wheels are cylindrical in shape and generally have horizontal channels that facilitate the adherence of a finger of the user (generally the thumb) for rotationally driving the wheel assembly during the lighting operation.

These channeled driving wheels are of a diameter greater than that of the striking wheel which, on one hand, avoids the bearing of the finger on the wheel itself and, on the other hand, increases the torque, thereby diminishing the force necessary to obtain sparks.

However, while the intent of such a design is to facilitate lighting of the lighter, the undesirable possibility of the lighter being ignited by a young child is also facilitated.

International Patent Publication No. WO 95/04247 discloses a lighter having a guard in the form of a resilient guard that is mounted between a pair of driving wheels and which covers a portion of the striking wheel. The user is required to apply sufficient force to depress the guard before the striking wheel assembly is able to be rotated.

Other known patent publications disclose the use of other types of abutments to block or limit the movement of the wheel assembly, including that which is disclosed in U.S. Pat. No. 4,717,335. In this patent, rotation of the striking wheel is blocked in one direction upon engagement of an abutment extending therefrom with a member fixed relative to the body of the lighter. Sparks can be generated, even after such engagement, albeit in a direction away from the flint.

SUMMARY OF THE INVENTION

The object of the present invention is to overcome the disadvantages in prior art lighters and to propose a lighter incorporating a simple and inexpensive solution to the problem of child safety.

The present invention is based on the idea that this safety can be assured by rendering the production of sparks from the lighter more difficult for a child. The fuel, even if it is released, dilutes rapidly into the atmosphere without danger since the source of ignition thereof is prevented.

According to the invention, the wheel assembly of the lighter, includes a central wheel, preferably cylindrical, carrying a flint on one end, mounted on the body of the lighter by means of a transverse axis and surrounded by two drivers, wherein the assembly includes means to increase the difficulty of driving the wheel.

According to another embodiment of the invention, the drivers each have a ring of diameter greater than that of the drivers.

Thus, the child's finger, which is of limited width and thickness, bears on the ring which is smooth. This prevents the rotation of the drivers and, consequently, of the wheel.

The rings can be loosely mounted on the axis of the wheel or on the drivers and, in this case, the action of a child's finger only translates into a rotation of the rings. On the other hand, when an adult exerts a pressure on the drivers, his or her thumb, having dimensions greater than those of the child's thumb, presses in a manner so as to come into contact with the channeled surface of the drivers to obtain the desired rotation of the striking wheel.

The rings can likewise be affixed to the driving wheels, but the small contact zone of the child's finger with the aforementioned rings causes a sliding of the finger on the ring without driving the striking wheel. In this case, the sliding of the finger on the ring has the same result as the loose rotation thereof.

In yet another embodiment of the invention, the external diameter of the rings can be designed to be greater than the external diameter of the drivers such that when an adult's finger presses on the wheel assembly, the pressure effect permits the contact with the driving wheels to obtain the adherence or friction necessary to rotationally drive the wheel and to generate sparks for lighting the lighter. Of course, the pressure necessary to obtain lighting is a function of the relative dimensions of the wheels and rings.

The smooth portions of the rings can be positioned either on the interior or the exterior of the driving wheels, even at the center thereof, or on both sides of each driving wheel.

According to another embodiment of the invention, there are no rings of diameter greater than that of the drivers. Instead, the driving wheels are channeled only, at most, over a portion of their widths. The rings are then replaced by smooth portions of the driving wheels having a low coefficient of friction which can be of one piece with the drivers having, in this case, a smooth portion and a channeled portion which are adjacent, the channeled portion having a diameter less than that of the smooth portion.

Under these conditions, a child's finger will not have the strength necessary to turn the driver, and consequently, to activate the wheel and generate sparks.

Furthermore, in prior lighters, the driving wheels have a cylindrical form. It is possible, so as to render lighting more difficult, to give to the driving wheels, seen in cross-section, a form in which the two ends are circular, the driver having the shape of a torus or a substantially ogival pointed form. A pressure greater than the normal pressure is then necessary to cause the rotation of the wheel, a pressure that a child can normally not exert, only an adult's thumb being able to deform itself sufficiently.

In summary, according to certain embodiments of the invention, the generation of sparks and, consequently, the lighting of the lighter is made dependent upon the greater width of an adult's thumb and/or the greater pressure that an adult can apply to the driving wheel(s) to thereby overcome various structural impediments that prevent the lighter of the lighter by a child. Further, according to the invention, a child safety lighter is proposed which nevertheless enables the lighting of the lighter with but a single manupulation, e.g., a mere rotation of the driving wheel(s) by an adult, regardless of the relative rotational position of the driving wheel (s).

BRIEF DESCRIPTION OF THE DRAWINGS

The invention will be more fully described and other characteristics and advantages of the invention will become apparent from the description that follows with reference to the annexed drawings that are provided only as non-limiting examples thereof and in which the same references designate the same elements, and wherein.

DETAILED DESCRIPTION OF THE PREFERRED EMBODIMENTS

With respect to the drawings, only enough of the construction of the invention has been depicted, to simplify the illustration, as needed for those of ordinary skill in the art to readily understand the underlying principles and concepts of the present invention.

Figure 1:
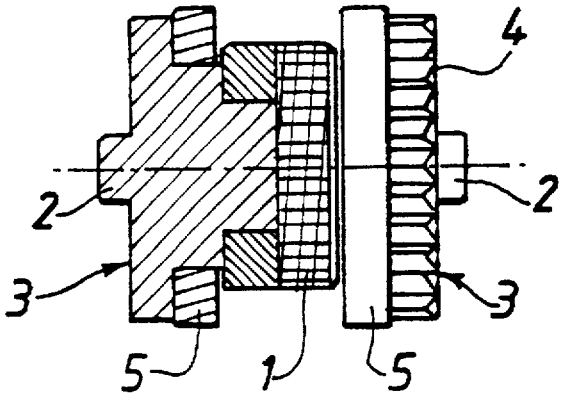
FIG. 1 is a vertical front elevation, half cross-sectional view of a wheel assembly for a lighter according to the invention.

FIG. 1 illustrates a first embodiment of the invention. A striking wheel 1 is shown, the striking wheel being rotatable around an axis about which the axles or axle stubs 2 are positioned. As is known, the striking wheel has a knurled surface in contact with a flint, described below in connection with FIG. 9, for generating sparks for igniting the fuel of the lighter.

In the example shown, the axles 2 are unitary with the driving wheels or drivers 3. Further, the striking wheel 1 is mounted fast to the axle/driver assembly so as to rotate upon rotation of the drivers. In this embodiment, the two drivers 3 have, as known per se, horizontal channels 4 adapted to increase the adherence of the finger of the user on the drivers.

Although the design having a pair of drivers between which a striking wheel is sandwiched as illustrated, it is contemplated that a single driver 3 could be utilized, a striking wheel 1 being laterally positioned on either side.

Further, although the axle 2 is shown to be fixedly connected to the drivers and striking wheel for common rotation, it is contemplated that the driver(s) and striking wheel could be commonly joined, unitary if desired, and journalled upon an axle or pin fixed with respect to the body of the lighter.

According to the invention, a ring 5 is mounted on each of the drivers 3. In the example of FIG. 1, each ring 5 is positioned interiorly with respect to a respective driver. However, each ring can be mounted exteriorly thereto, or along the center of the drivers. The rings 5 are mounted freely upon the axle 2 such that they can turn freely thereon and, therefore, have no effect on the rotation of the striking wheel 1. It is likewise possible to provide a ring on both sides of each driver (not shown).

It is contemplated that the rings and drivers can be of one piece, i.e., unitary. In this case, it is the absence of adherence of the finger of a child which prevents lighting. That is, lacking sufficient friction with the ring, the child's finger merely slips around the periphery of wheel. Thereby, the movement, or turning, of the drivers and the ignition of the lighter is impeded. That is, such movement and lighting is rendered more difficult than if the arrangement of the ring were not present. It is contemplated, for example, that the ring could even be provided with a chrome or polytetrafluoroethylene (TEFLON) coating or other such means to reduce the friction of one's finger, particularly the finger of a child, with respect to the ring. By such means, the outer surface of the ring is made less tractive than the outer surface of the drivers.

Figure 2:
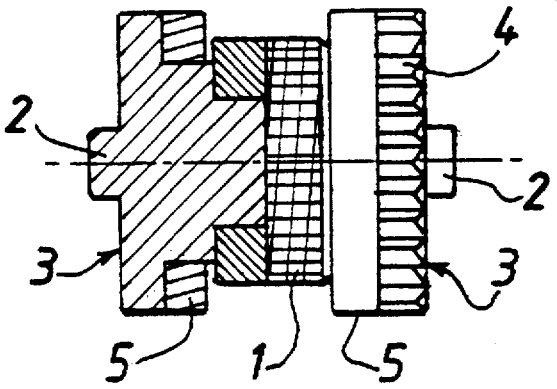
FIG. 2 is another embodiment having partially channeled driving wheels.

Another solution to the problem of safety of the wheel comprises partially eliminating, even totally eliminating, the channels of the drivers such that the adherence of a finger is thus reduced and so that a child cannot drive the wheel due to an inability to apply sufficient pressure over a substantial surface to induce a rotational torque to the striking wheel and overcome the friction thereof on the flint. Such an arrangement is shown in front view in FIG. 2 in which portion 5, having the same diameter as the driver, plays the same role as the ring. The functioning is the same as previously described.

Figure 3:
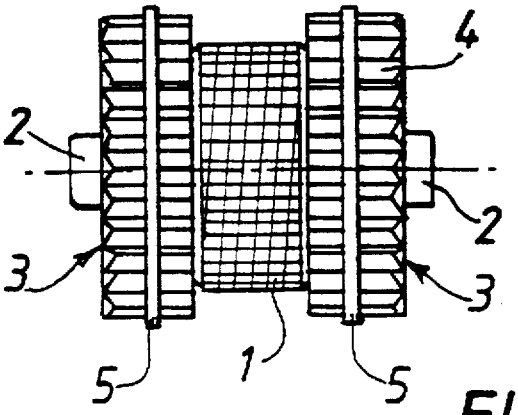
FIG. 3 is another embodiment in which the ring is mounted on the driving wheels in the central position.

According to yet another embodiment, the rings 5, having a reduced width, are mounted between the exterior and the interior of each driver. As shown in FIG. 3, the rings 5 are positioned at the center of the drivers 4.

Figure 4:
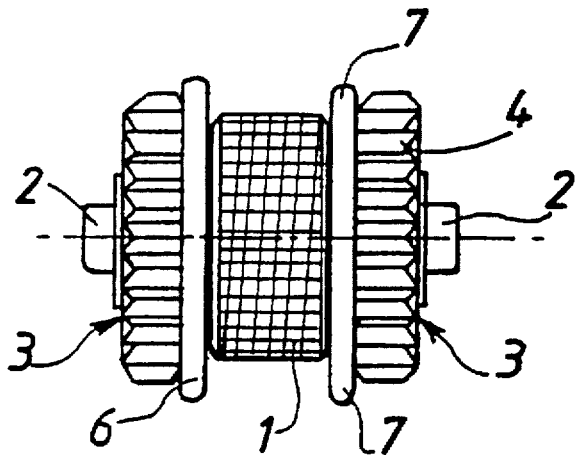
FIG. 4 is a wheel assembly in which the driving wheels have a toric or ogival shape.

As shown in FIG. 4, another solution according to the invention includes giving to the drivers a peripheral non-planar form, for example, toric or ogival, which is not well-adapted for the application of sufficient pressure on the driver by the finger of a child. The form of the rings can likewise be toric 6 or ogival 7. More specifically, as seen in FIG. 4, the outer peripheral surface of the driving wheels 4 and the rings 6, 7 are not perfectly cylindrical. Instead, their peripheries are somewhat rounded from side to side. The ogival shape of ring 7 is more pointed near the center of the transverse periphery.

Figure 5:
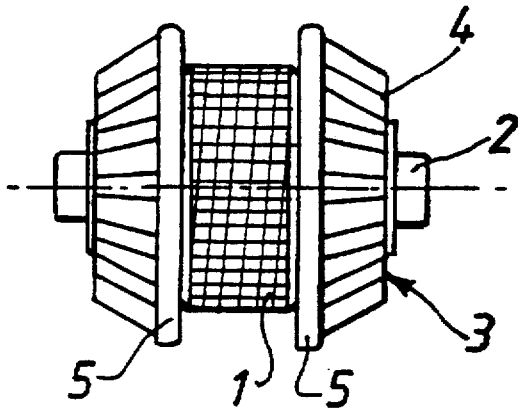
FIG. 5 is another embodiment in which the driving wheels have a truncated conical shape.
Figure 6:
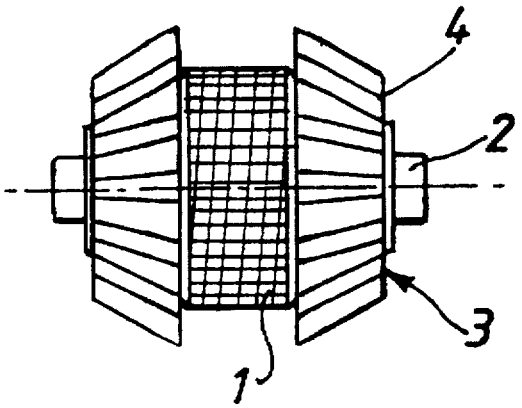
FIG. 6 is another embodiment, similar to that of FIG. 5, but in which the rings are eliminated.

Another form of the driver is shown in FIG. 5. The drivers 3 are, in this case, truncated rather than cylindrical, i.e., they have a frusto-conical shape. It is contemplated that, although rings 5 are shown in FIG. 5, the rings can be eliminated, as shown in FIG. 6. In either embodiment, a substantial deformation of the thumb, which can occur only for the thumb of an adult, is required to drive the central wheel 1.

Figure 7:
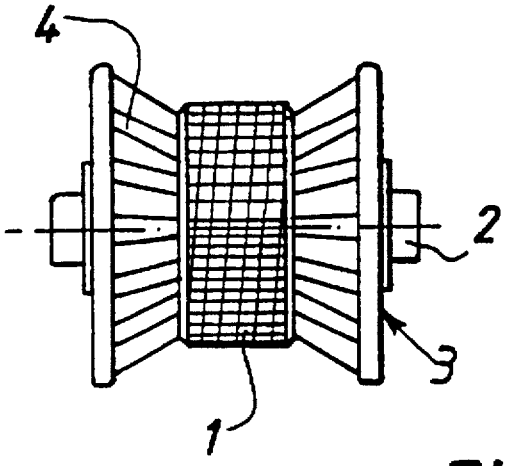
FIGS. 7 and 8 are two other embodiments in which the driving wheels are particularly shaped.

In FIG. 7, the slope of the truncated cones constituting the drivers is inverse with respect to that of FIG. 5, the greatest diameter being found on the exterior, or lateral most sides of the assembly.

Figure 8:
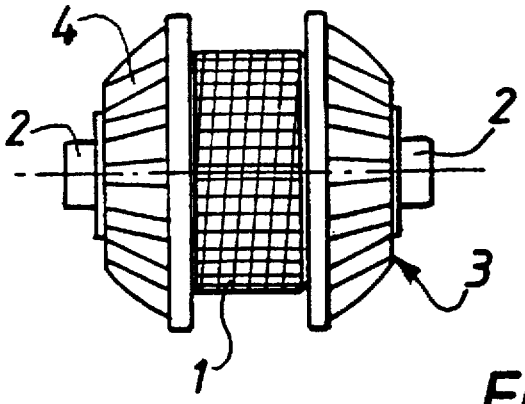

FIG. 8 is analogous to FIG. 5, but the drivers are formed by spherical sectors. That is, from one side to the other, the driving wheels 4 have a profile that is constituted by a portion of a sphere.

As with the embodiment of FIG. 6, it is contemplated that the rings can be eliminated in the embodiments of FIGS. 7 and 8, if desired.

Figure 9:
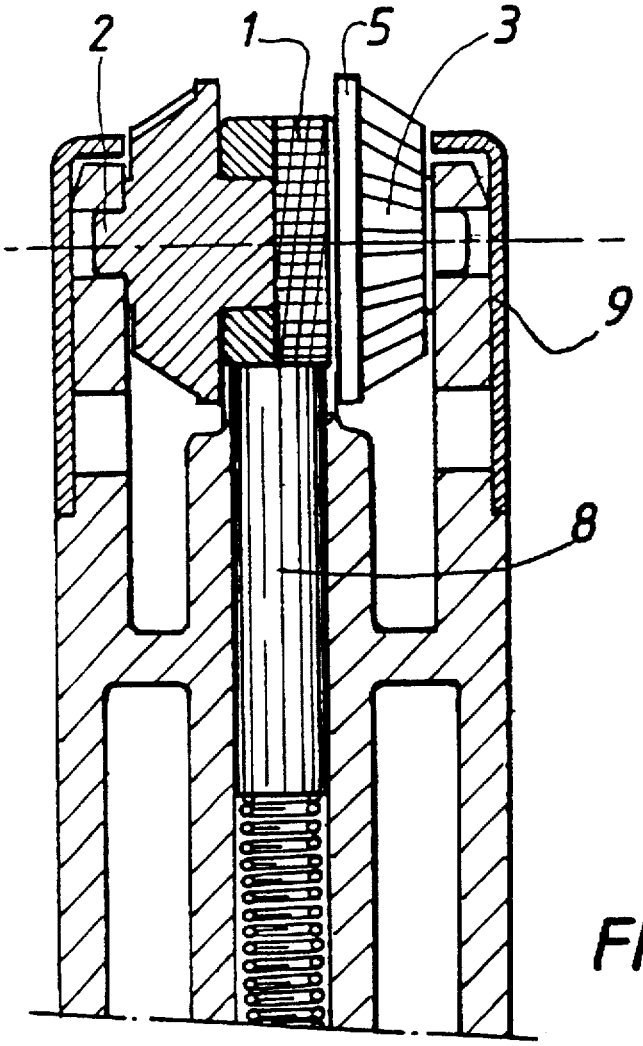
FIG. 9 is a vertical cross sectional view of a lighter that includes an exemplary embodiment of the wheel assembly of the invention.
Figure 10:
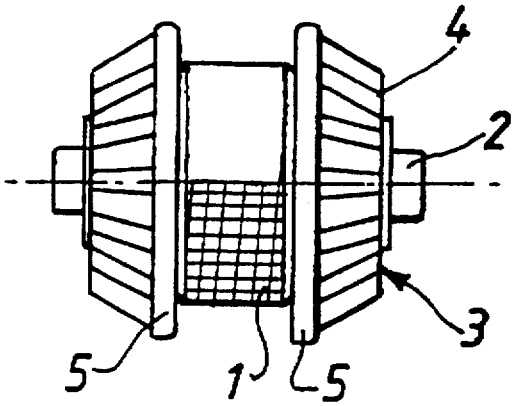
FIG. 10 is an embodiment in which the striking wheel includes knurling over less than its entire periphery.

FIG. 9 shows a cross-section of a lighter on a vertical plane passing through the axis of the wheel. The drivers 3 are of the type shown in FIG. 5. It is seen that the striking wheel 1 is in contact with the flint 8 and that the axles 2 are journalled in the body of the lighter 9. So as to increase the safety of operation, it is possible, according to another feature of the invention, as shown in FIG. 10, to eliminate the toothing, knurling, or friction surface of the striking wheel 1 over a portion of its surface such that, statistically, the wheel only generates sparks in every other rotation (on the order of a half rotation). Such an arrangement can discourage children from attempting to ignite the lighter without discouraging adults. In such an embodiment, the rings can be considered an optional feature.

It is self-evident that numerous variations can be applied, particularly by substitution of equivalent technical means, without going beyond the scope of the invention. Thus, the invention is not limited to the embodiments expressly described and represented as examples, and also comprises all technical equivalents and combinations thereof.

What is claimed is:

1. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel; and a device, mounted for rotation about said axis, for impeding manual turning of said two drivers about said axis in either direction, independent of a relative rotational position of either of said two drivers with respect to said axis, and for impeding generation of sparks by said spark producing member.

2. A lighter according to claim 1, wherein:

each of said drivers comprises a substantially toric cross section.

3. A lighter according to claim 1, wherein:

said striking wheel includes a periphery, only a portion of said periphery including a knurled surface.

4. A lighter according to claim 1, further comprising:

a transverse axle member extending along said axis, said striking wheel and said two drivers being mounted fast upon said axle member for rotation with said axle member.

5. A lighter according to claim 1, wherein:

each of said drivers has a non-cylindrical shape.

6. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said spark producing member;

wherein said drivers comprise a pair of driving wheels having a predetermined diameter; and wherein said device comprises at least two rings, each of said two rings having a diameter greater than said predetermined diameter of said drivers, at least one of said two rings being mounted upon each of said driving wheels.

7. A lighter according to claim 6, wherein:

said two rings mounted upon said driving wheels are mounted for free rotation around said driving wheels.

8. A lighter according to claim 6, wherein:

said two rings mounted upon said driving wheels are mounted fast to said driving wheels for rotation with said driving wheels.

9. A lighter according to claim 6, wherein:

said two rings mounted upon said driving wheels are unitary with said driving wheels.

10. A lighter according to claim 6, wherein:

each of said drivers has a non-cylindrical shape.

11. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said spark producing member;

wherein each of said drivers has a periphery, said periphery including a portion having plurality of channels for facilitating adherence of a finger on said driving wheels, and further including a remaining portion having a smooth surface.

12. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said spark producing member;

wherein each of said drivers has a frusto-conical shape.

13. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said spark producing member;

wherein each of said drivers has a cross section shaped in the form of a spherical section.

14. A lighter wheel assembly comprising:

a central cylindrical wheel extending along a predetermined axis and being adapted to be mounted for rotation about said axis within a lighter body, said central cylindrical wheel comprising a striking wheel for bearing upon an end of a flint for generating sparks;

two drivers mounted on respective opposite sides of said striking wheel, said two drivers being mounted for rotation with said striking wheel; and a device, mounted for rotation about said axis, for impeding manual turning of said two drivers about said axis in either direction, independent of a relative rotational position of either of said two drivers with respect to said axis, and for impeding generation of sparks by said striking wheel.

15. A lighter wheel assembly according to claim 14, wherein:

each of said drivers comprises a substantially toric cross section.

16. A lighter wheel assembly according to claim 14, wherein:

said striking wheel includes a periphery, only a portion of said periphery including a knurled surface.

17. A lighter wheel assembly according to claim 14, further comprising:

a transverse axle member extending along said axis, said striking wheel and said two drivers being mounted fast upon said axle member for rotation with said axle member.

18. A lighter according to claim 14, wherein:

each of said drivers has a non-cylindrical shape.

19. A lighter wheel assembly comprising:

a central cylindrical wheel extending along a predetermined axis and being adapted to be mounted for rotation about said axis within a lighter body, said central cylindrical wheel comprising a striking wheel for bearing upon an end of a flint for generating sparks;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said striking wheel;

wherein said drivers comprise a pair of driving wheels having a predetermined diameter; and wherein said device comprises at least two rings, each of said two rings having a diameter greater than said predetermined diameter of said drivers, at least one of said two rings being mounted upon each of said driving wheels.

20. A lighter wheel assembly according to claim 19; wherein:

said two rings mounted upon said driving wheels are mounted for free rotation around said driving wheels.

21. A lighter wheel assembly according to claim 19, wherein:

said two rings mounted upon said driving wheels are mounted fast to said driving wheels for rotation with said driving wheels.

22. A lighter wheel assembly according to claim 19, wherein:

said two rings mounted upon said driving wheels are unitary with said driving wheels.

23. A lighter according to claim 19, wherein:

each of said drivers has a non-cylindrical shape.

24. A lighter wheel assembly comprising:

a central cylindrical wheel extending along a predetermined axis and being adapted to be mounted for rotation about said axis within a lighter body, said central cylindrical wheel comprising a striking wheel for bearing upon an end of a flint for generating sparks;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said striking wheel;

wherein each of said drivers has a periphery, said periphery including a portion having plurality of channels for facilitating adherence of a finger on said driving wheels, and further including a remaining portion having a smooth surface.

25. A lighter wheel assembly comprising:

a central cylindrical wheel extending along a predetermined axis and being adapted to be mounted for rotation about said axis within a lighter body, said central cylindrical wheel comprising a striking wheel for bearing upon an end of a flint for generating sparks;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said striking wheel;

wherein each of said drivers has a frusto-conical shape.

26. A lighter wheel assembly comprising:

a central cylindrical wheel extending along a predetermined axis and being adapted to be mounted for rotation about said axis within a lighter body, said central cylindrical wheel comprising a striking wheel for bearing upon an end of a flint for generating sparks;

two drivers mounted on respective opposite sides of said striking wheel, said two drivers being mounted for rotation with said striking wheel;

a device, mounted for rotation about said axis, for impeding manual turning of said two drivers about said axis in either direction and for impeding generation of sparks by said striking wheel;

wherein each of said drivers has a spherical sector shape.

27. A lighter comprising:

a lighter body;

a spark producing member mounted within said lighter body;

a striking member mounted for movement about a predetermined axis within said lighter body for engagement with said spark producing member for generating sparks upon movement of said striking member during engagement with said spark producing member;

a driving member mounted for movement about said axis, said driving member being accessible for manipulation by a user, a connection between said striking member and said driving member such that said manipulation of said driving member results in said movement of said driving member about said axis, said movement of said driving member about said axis thereby causing said movement of said striking member about said axis;

means for mounting said driving member and said striking member for said rotation about said axis; and means mounted for rotation about said axis for impeding movement of said driving member about said axis at any rotational position of said driving member, in either direction about said axis, and, thereby, for impeding generation of sparks.

28. A lighter comprising:

a lighter body;

a spark producing member mounted within said lighter body;

a striking member mounted for movement about a predetermined axis within said lighter body for engagement with said spark producing member for generating sparks upon movement of said striking member during engagement with said spark producing member;

a driving wheel mounted for movement about said axis, said driving wheel having an outer surface accessible for manipulation by a user, a connection between said striking member and said driving wheel such that said manipulation of said driving wheel results in said movement of said driving wheel about said axis, said movement of said driving wheel about said axis thereby causing said movement of said striking member about said axis;

means for mounting said driving wheel and said striking member for said rotation about said axis; and a ring mounted for rotation about said axis, said ring having an outer surface, said outer surface of said ring being less tractive than said outer surface of said driving wheel.

29. A lighter according to claim 28, wherein:

said ring has an outer circumferential surface having a diameter at least substantially the same as an outer circumferential surface of said driving wheel.

30. A lighter according to claim 29, wherein:

said ring is mounted for rotation about said axis relative to said driving wheel.

31. A lighter according to claim 30, wherein:

said ring is mounted for rotation with said driving wheel.

32. A lighter according to claim 31, wherein:

said ring is unitary with said driving wheel.

33. A lighter comprising:

a lighter body;

a spark producing member mounted within said lighter body;

a central cylindrical wheel mounted for rotation within said lighter body about an axis, said central cylindrical wheel comprising a striking wheel bearing upon one end of said flint;

at least one driver mounted laterally of said striking wheel, said driver being mounted for rotation with said striking wheel;

said striking wheel having an outer circumferential surface, said outer circumferential surface having a friction surface portion for engagement with said spark producing member and for producing a spark from said engagement, said outer circumferential surface further having a non-spark-producing surface portion, said non-spark-producing surface portion being incapable of producing a sparks; and means for impeding manual turning of said driver about said axis in either direction about said axis, and at any rotational position of said driver, for impeding generation of sparks.

34. A lighter according to claim 33, wherein:

said non-spark-producing surface portion has a smoother surface than said friction surface portion.

35. A lighter according to claim 33, wherein:

said means for impeding manual turning of said driver about said axis comprises a ring having an outer surface smoother than an outer surface of said driver.

36. A lighter according to claim 33, wherein:

said means for impeding manual turning of said driver about said axis comprises a ring having an outer surface extending about said axis; and means for mounting said ring for movement about said axis with respect to said driver.

37. A lighter according to claim 33, wherein:

said non-spark-producing surface portion extends for approximately one-half said outer circumferential surface.

38. A lighter according to claim 34, wherein:

said non-cylindrical shape is a frusto-conical shape.

39. A lighter comprising:

a lighter body;

a spark producing member in the form of a flint mounted within said lighter body;

a central cylindrical wheel mounted for rotation within said lighter body about an axis, said central cylindrical wheel comprising a striking wheel bearing upon one end of said flint;

two drivers mounted on respective opposite sides of said striking wheel, said two drivers being mounted for rotation with said striking wheel;

wherein each of said driving wheels has a non-cylindrical shape.

40. A lighter comprising:

a lighter body;

a flint mounted within said lighter body;

a striking wheel mounted for rotation within said lighter body about an axis, said striking wheel bearing upon one end of said flint for generation of a spark upon relative movement of said striking wheel against said flint;

a driver mounted for rotation with said striking wheel, a surface of said driver being exposed for manipulation; and means for impeding generation of sparks by said flint as a function of a magnitude of radial pressure applied to said driver, independent of a relative rotational position of said driver with respect to said axis, while enabling said generation of sparks with a single manipulation of said lighter.

41. A lighter comprising:

a lighter body;

a flint mounted within said lighter body;

a striking wheel mounted for rotation within said lighter body about an axis, said striking wheel bearing upon one end of said flint for generation of a spark upon relative movement of said striking wheel against said flint;

a driver mounted for rotation with said striking wheel, a surface of said driver being exposed for manipulation by a thumb of a user for rotation of said driver; and means for impeding generation of sparks by said flint as a function of a thumb of a user having a width less than a certain magnitude and for allowing generation of sparks by said flint as a function of a thumb of a user having a width greater than or equal to a certain magnitude, while enabling said generation of sparks with a single manipulation of said lighter by said thumb of a user having a width greater than or equal to a certain magnitude being applied to said driver for rotation of said driver independent of a relative rotational position of said driver with respect to said axis.

* * * * *